US005460301A

United States Patent [19]

Ebinger et al.

[11] Patent Number: 5,460,301

[45] Date of Patent: Oct. 24, 1995

[54] CONCRETE PUMP VEHICLE

[75] Inventors: Willi Ebinger, Steinenbronn; Dieter Schneider, Filderstadt, both of Germany

[73] Assignee: Putzmeister-Werk Maschinenfabrik GmbH, Aichtal, Germany

[21] Appl. No.: 302,924

[22] PCT Filed: Dec. 12, 1992

[86] PCT No.: PCT/EP92/02881

§ 371 Date: Sep. 19, 1994

§ 102(e) Date: Sep. 19, 1994

[87] PCT Pub. No.: WO93/18991

PCT Pub. Date: Sep. 30, 1993

[30] Foreign Application Priority Data

Mar. 19, 1992 [DE] Germany ..... 42 08 831.3

[51] Int. Cl.[6] ..... F04B 17/06

[52] U.S. Cl. ..... 222/626; 137/625; 220/335; 417/900

[58] Field of Search ..... 222/108, 533, 222/527, 626; 417/900; 137/625; 141/86, 311 A; 296/38; 220/263, 264, 335, 908

[56] References Cited

U.S. PATENT DOCUMENTS

| | | | |
|---|---|---|---|
| 3,507,347 | 4/1970 | Bennett | 417/900 |
| 3,572,380 | 3/1971 | Jackson et al. | 137/615 |
| 3,942,688 | 3/1976 | Pryor et al. | 222/108 |
| 4,130,134 | 12/1978 | Castle | 222/527 |
| 4,625,760 | 12/1986 | Mertens | 137/615 |
| 4,788,999 | 12/1988 | Dalpare | 220/335 |

FOREIGN PATENT DOCUMENTS

| | | |
|---|---|---|
| 2017946 | 10/1971 | Germany . |
| 2240190 | 2/1974 | Germany . |
| 1812500 | 7/1975 | Germany . |
| 2655582 | 6/1978 | Germany . |
| 2728420 | 1/1979 | Germany . |
| 2833375 | 2/1980 | Germany . |
| 8008474 | 7/1980 | Germany . |
| 3409474 | 9/1985 | Germany . |

OTHER PUBLICATIONS

Patents Abstracts of Japan M–1160 Sep. 20, 1991 vol. 15/No. 374 Japanese Patent No. 3–149360, Dated Jun. 25, 1991 (1 page).

*Primary Examiner*—Andres Kashnikow
*Assistant Examiner*—Philippe Derakshani
*Attorney, Agent, or Firm*—Flynn, Thiel, Boutell & Tanis

[57] ABSTRACT

A concrete pump vehicle has a foldable concrete distributing boom (18) arranged on a chassis (10), a material container (24) arranged next to the rear end of the chassis (10) and a concrete pump (28) connected at its suction side to the material container (24) and at its delivery side to a delivery line (26) that extends over the distributing boom (18). The material container (24) is provided with an anti-splashing device that projects over the edge of the opening and ensures that no concrete splashes reach the machine area during operation of the pump. In order to achieve an optimal splash-protection in both the traveling and working states, the anti-splash device has a wall structure (36) that projects over the edge of the opening and a foldable wall (40) hingedly linked to the area of the upper edge of the wall structure (36). The foldable wall (40) has a swivelling area that overlaps the folded distributing boom (18) and can swivel in a limited range between a traveling position in which it covers the filling opening (30) and a working position, i.e. lifted with respect to the traveling position by 90° C., only when the distributing boom (18) is lifted off its support (48). The foldable wall can be locked in both positions.

18 Claims, 4 Drawing Sheets

CONCRETE PUMP VEHICLE

FIELD OF THE INVENTION

The invention relates to a concrete pump vehicle with a chassis constructed as a truck chassis, with a bearing block arranged in the front zone of the chassis, with a distributor boom turnable on the bearing block about a vertical axis and swingable about a horizontal axis, consisting of several boom arms limitedly swingable with respect to one another about horizontal axes, supportable in the folded state on at least one support place constructed as boom support block in the rearward zone of the chassis, with a material container arranged in the vicinity of the rearward end of the chassis, having an upward-facing filling opening, with a concrete pump connected to the material container in the zone of a pump-side boundary wall and connected on a pressure side thereof with a delivery line arrangement provided on the distributor boom, and with a splash guard arrangement upstandingly arranged in the zone of the pump-side boundary wall of the material container on a border of the filling opening.

BACKGROUND OF THE INVENTION

In known concrete pump vehicles the spray guard arrangement is mostly constructed as a sheet metal box permanently installed on the pump side of the material supply container, which box provides that the concrete splashes arising inside the material container in the pumping of the concrete cannot pass into the region of the pump. It has proved, however, that an efficient spray protection can be achieved only with a sufficient structural height of the sheet metal box. This requires, on the other hand, a sufficient free space under the distributor boom supported on the chassis, which space, especially in the case of large distributor booms is not always available. In the traveling state the filling opening of the material container is often closed with a funnel covering constructed as a rubber mat. Thereby there is avoided a splashing out of the concrete during travel as well as an excessively rapid hardening of the concrete, for example by solar radiation.

Proceeding from this, underlying the invention is the problem of developing a splash guard arrangement for the material feed container of a concrete pump vehicle, which independently of the size of the distributor boom, ensures an effective spray protection both in the working state and also in the traveling state.

For the solution of this problem there is proposed the combination of features wherein the splash protection arrangement includes a lockable lid articulated on the material feed container which is swingable from a traveling position at least partially overlapping an opening of the container to a working position pivoted 90° relative to the traveling position when the distributor boom is lifted from its support place, and further developments of the invention are yielded as described herein.

The solution according to the invention proceeds from the thought that the splash protection is provided only during the pump operation, therefore with concrete pump vehicle at a standstill and distributor boom raised, requires a sufficient structural height to catch the concrete sprays. In traveling operation, in which the distributor boom is folded up and supported on the boom support block, however, such a structural height of the spray protection arrangement is not needed. For this reason it is proposed according to the invention that the splash protection arrangement have on the pump-side boundary wall of the material container, a rigid wall structure rising somewhat above the edge of the container, and that in the zone of the upper edge of the wall structure that is at a distance from the filling opening there be articulated a rigid lid swingable transversely to the horizontal axis extending transversely to the chassis, the swiveling range of which overlaps with that of the folded-together distributor boom and which with the distributor boom raised from its supporting place is limitedly swingable from a traveling position at least partly overlapping the container opening into a working position open by about 90° with respect to this, and is arrestable in the positions mentioned. The lid has here a double function. In the working position, it presents a sufficiently high splash catcher, while in the traveling position it serves as container cover. The rigid wall construction necessary for the bearing of the lid has such a low structural height that the distributor boom being supported by the material support block can be lowered to near the filling opening of the material container.

A preferred embodiment of the invention provides that the wall structure is bounded by two side walls, which project upwardly from the edge of the side walls of the material container which are perpendicular to the pump-side boundary wall, while the lid has the form of a box-wall open to the side of the horizontal axis and to the filling opening, the side walls of which in the swinging of the lid are swingable parallel to the side walls of the wall structure under pairwise mutual overlapping.

In order to facilitate a lifting of the lid from its traveling position into the working position, a spring acting in the working-position direction engages on the lid. The spring is designed there appropriately as a tension spring between the flap wall and a chassis-fixed place, exerting a torque acting on the lid in the working-position direction.

According to a further advantageous embodiment of the invention, between the lid and a chassis-fixed part, preferably at the supporting place of the distributor boom, there is arranged a locking mechanism, which in the working position of the lid locks into place automatically. Advantageously the locking mechanism is automatically releasable under the action of the folded distributor boom swinging in the support-place direction, the lid being swung after a releasing of the locking connection, preferably under the action of the distributor boom swinging, out of its working position in the support-place direction, in the direction toward the traveling position. The locking mechanism advantageously has a fixed locking member arranged on the chassis-fixed part and a swingable locking member swingable limitedly about a horizontal axis, lockable automatically on the fixed lock member over an inclined slope. The swingable lock member can be constructed there as a swivel lever with a locking recess opening downward in the locked state, lockable under the action of gravity and/or of a spring upon the fixed lock member, which lever is swingable into its engaged position over an activating member triggerable preferably under the action of the distributor boom swinging in the support-place direction. The actuating member expediently has a spring-loaded thrust rod guided on the lid, articulated on one lever arm of a two-armed pivot lever, and extending beyond the edge of the lid at its free end. The automatic swinging of the lid from the working position into the traveling position is facilitated by the means that the lid in the working position extends obliquely upward to the rear, and in the traveling position obliquely downward to the rear substantially parallel to the plane of the filling opening.

An improvement of the splash protection both in the working position and also in the traveling position can be achieved by the means that the box-form lid overlaps in traveling position only a part of the filling opening and has on the free under-edge of its side wall lying opposite the horizontal axis a flap which is expediently articulated in pendulation in such manner that in the working position of the lid it hangs downward and in the traveling position it covers over the free part of the filling opening.

According to a further advantageous execution of the invention, the lid can be provided with a break-through covered by overlapping rubber plates for the reaching through of installation parts of the material container oriented over the filling opening. With these installation parts it is a matter, for example, of the upper part of a C-tube slider of the concrete pump and/or of the cleaning connecting piece of the delivery line being received into the material container.

For the arresting of the lid in traveling position, the lid is detachably connectable, by means of lateral rapid closures or hood latches, with the material container.

The material container can additionally be bounded by an apron, preferably made of rubber, extending outside the rigid wall structure above the edge of the filling opening, which apron partially overlaps the lid in its traveling position.

BRIEF DESCRIPTION OF THE DRAWINGS

In the following the invention is described in detail with the aid of an example of execution schematically represented.

DETAILED DESCRIPTION

Figure 1:
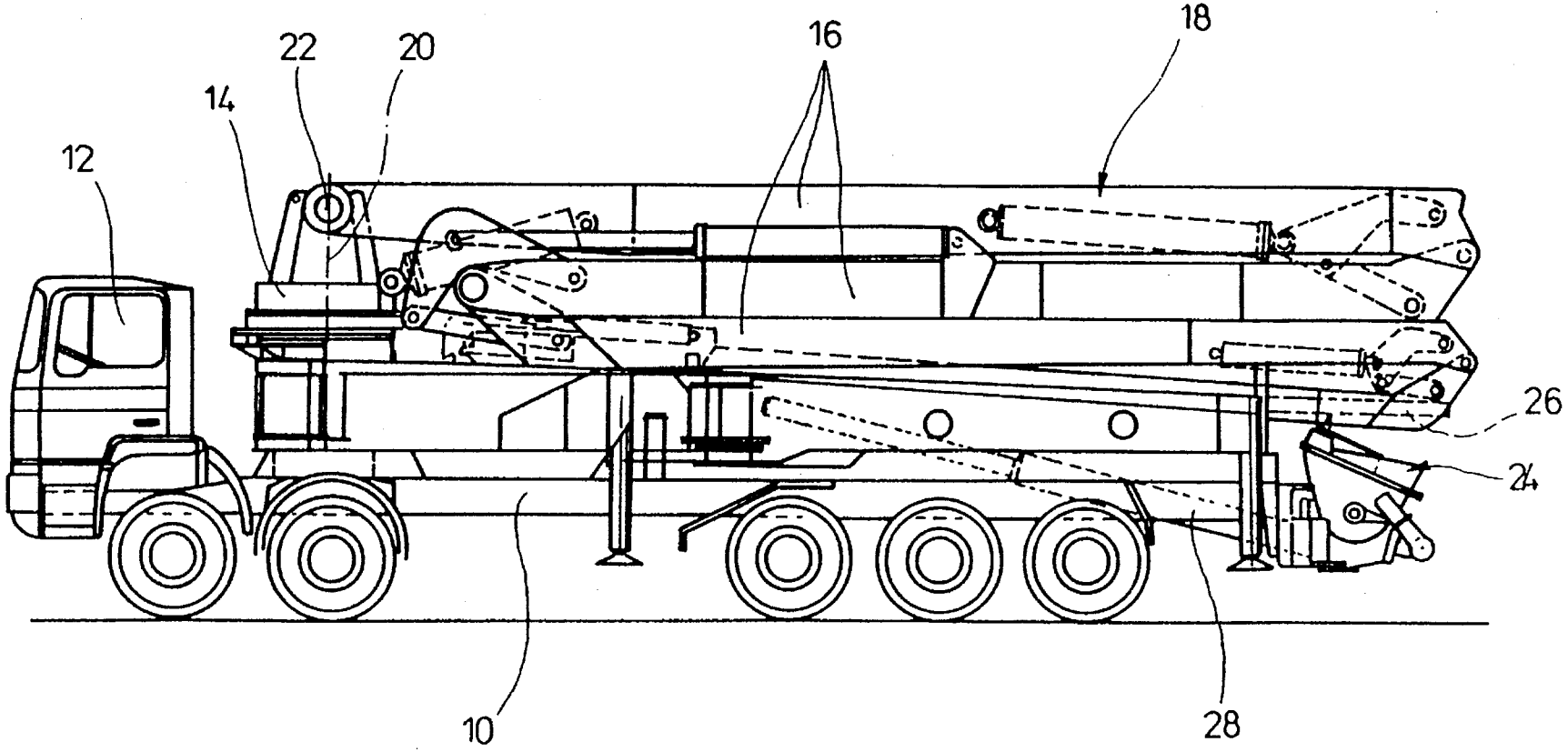
FIG. 1 shows a side elevation of a concrete pump vehicle with lowered distributor boom and splash protection in traveling position.

The concrete pump vehicle consists essentially of a chassis 10 constructed as a truck chassis with driver's cab 12, a bearing block 14 arranged in the front part of the chassis 10, on which block a distributor boom 18 consisting of several collapsible boom arms 16 is borne rotatably about a vertical axis 20 and is pivotable about a horizontal axis 22, a concrete pump 28 constructed as a two-cylinder piston pump, a material dispensing container 24 mounted on the rearward end of the chassis 10 and is connected to the suction side of the pump whereas the pressure side of the pump is connected to a delivery line 26 provided on the distributor boom 18. The material dispensing container 24 has an obliquely upward rearwardly facing filling opening 30 covered with a grating (not shown), which opening is bounded by a flange-type edge 32.

Figure 2:
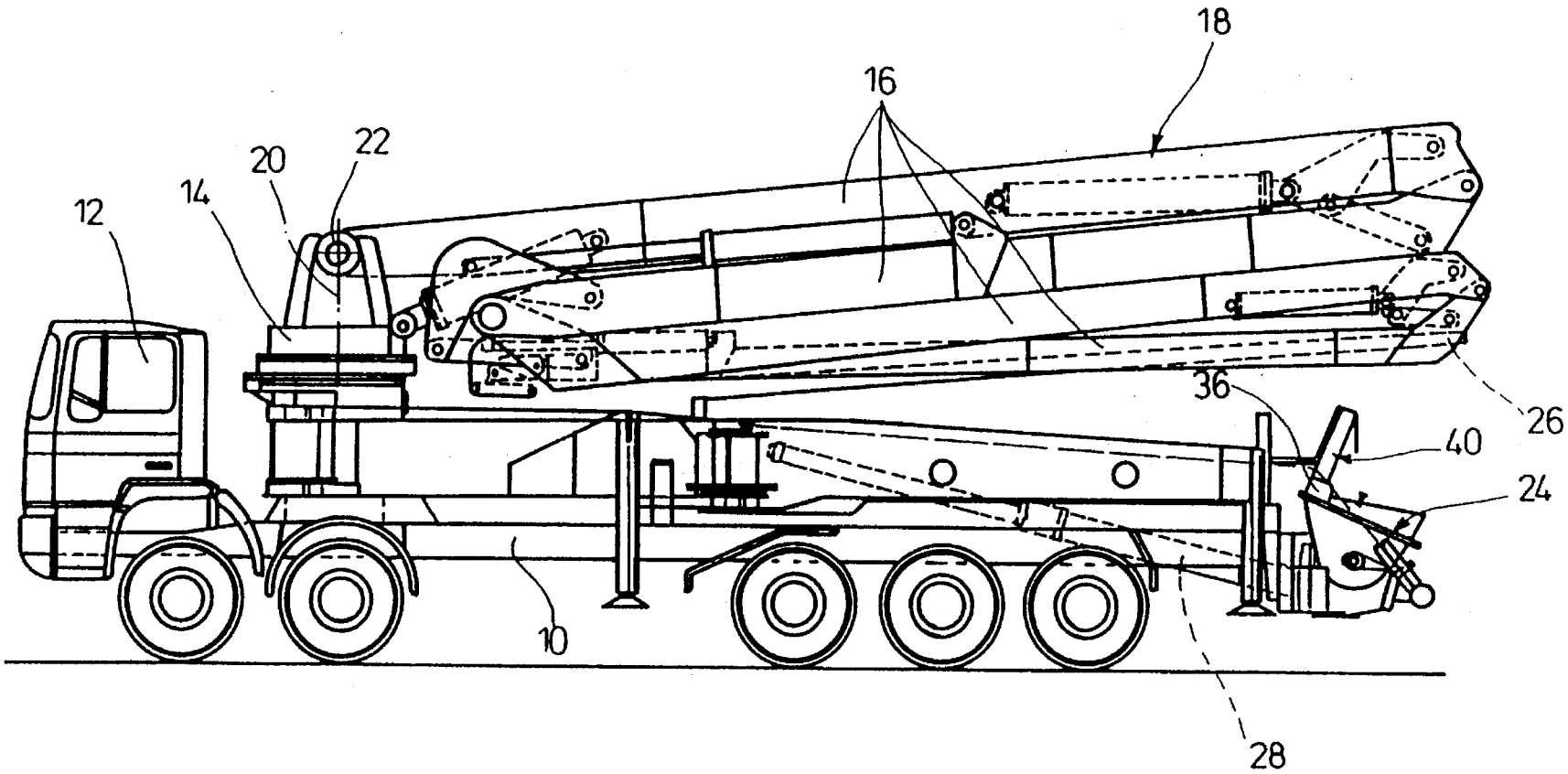
FIG. 2 a side elevation of the concrete pump vehicle with raised distributor boom and splash protection in working position.
Figure 3:
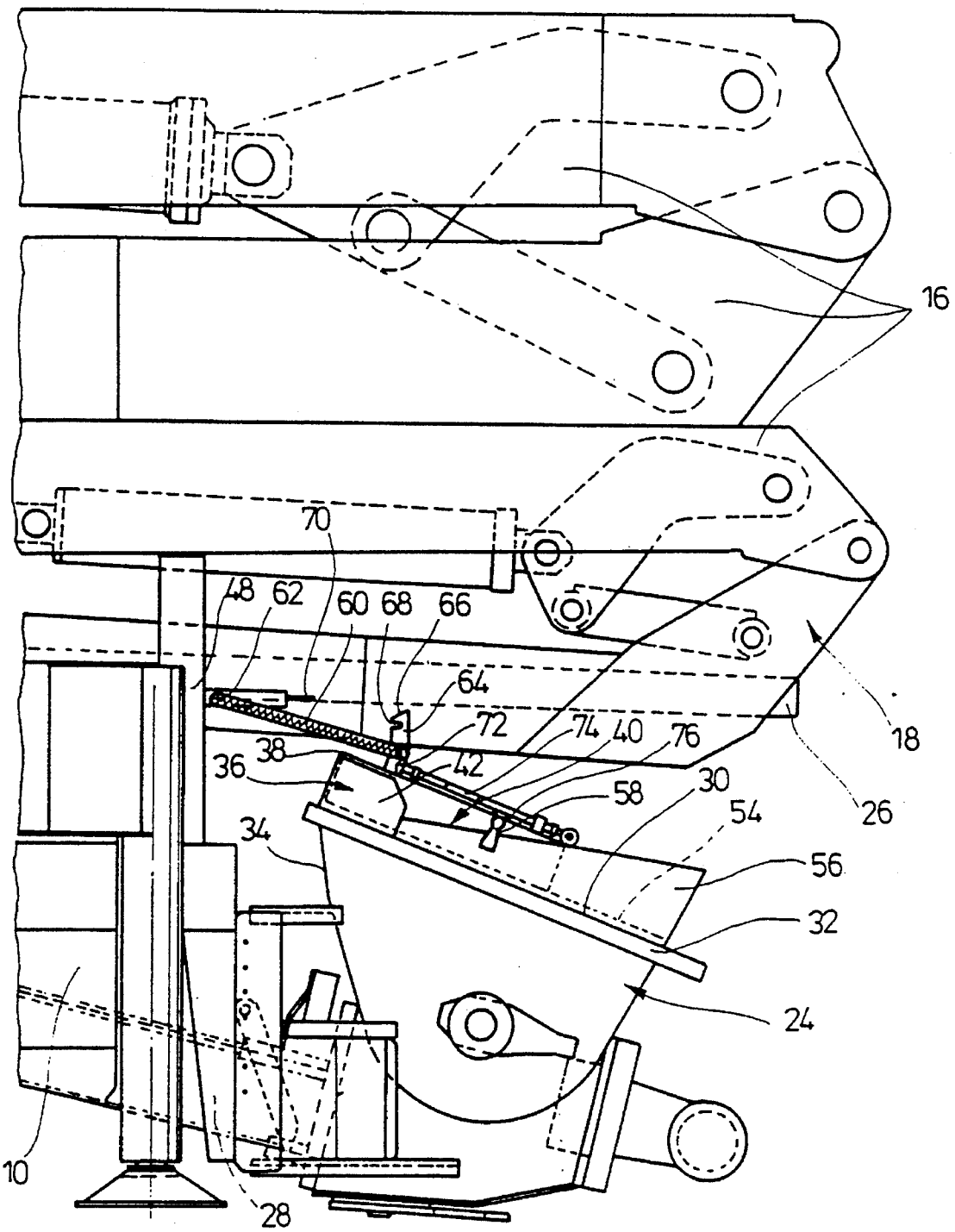
FIG. 3 an enlarged fragment of FIG. 1.
Figure 4:
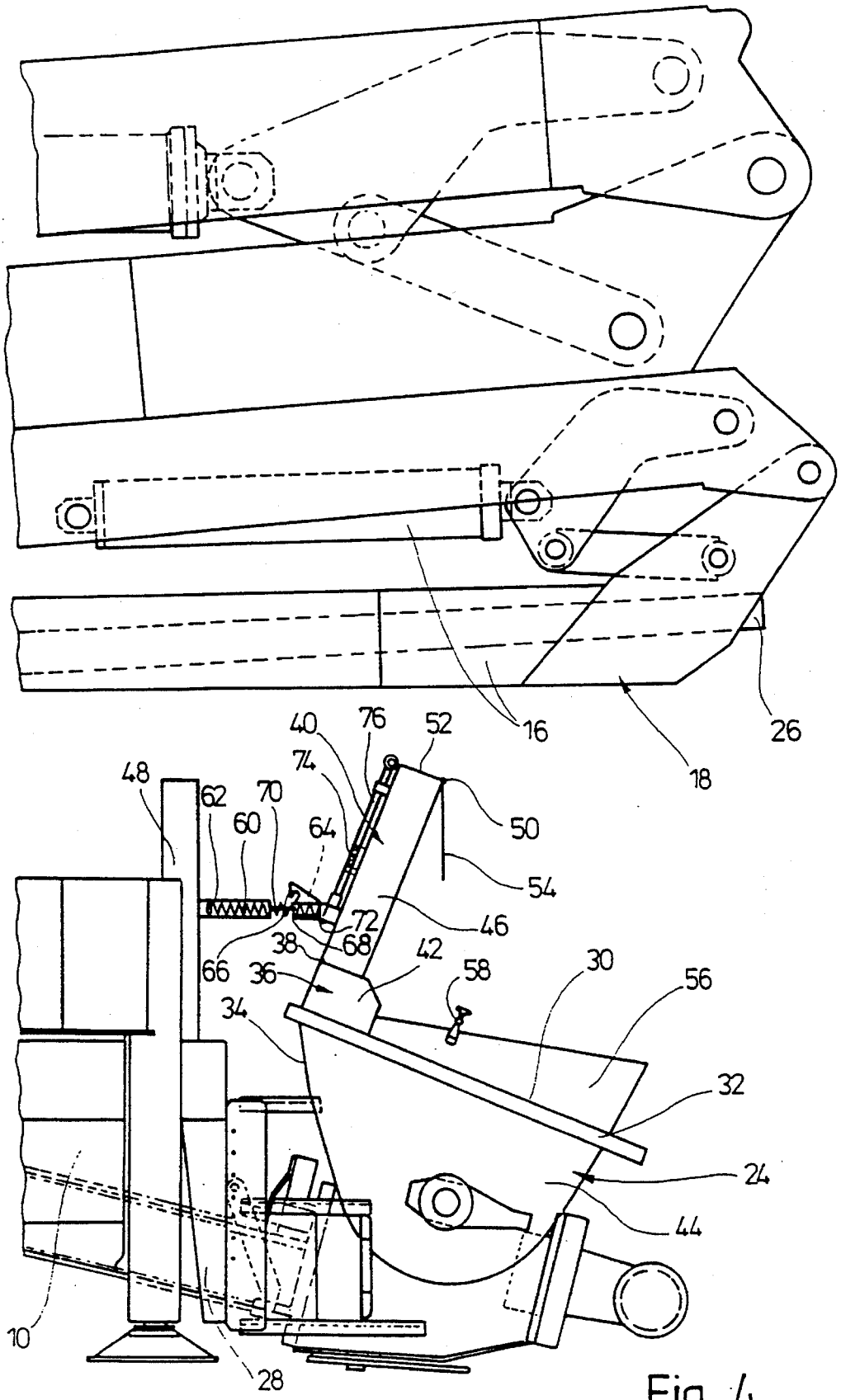
FIG. 4 an enlarged fragment of FIG. 2.

The material dispensing container 24 is provided, furthermore, with a splash guard arrangement which includes a rigid wall structure 36, U-shaped in cross section, arranged in the zone of a pump-side boundary wall 34 of the container 24, and upstandingly arranged on the edge 32, as well as a lid 40 swingably supported in the zone of an upper edge of the wall structure 36 about a horizontal axis 38 extending transversely to a longitudinal axis of the chassis 10. The wall structure 36 also includes two upstanding side walls 42 on the edge 32 above the side walls 44 of the material dispensing container 24, which walls 44 are perpendicular to the pump-side boundary wall 34. The lid 40 has side walls 46 forming a box, open-walled to the side adjacent the horizontal axis 38 and to the filling opening 30, the side walls 46 being oriented parallel to the side walls 42 of the wall structure 36, with pairwise mutual overlapping (cf. FIGS. 3 and 4). The swinging range of the lid 40 is correlated with the swinging range of the distributor boom 18, so that the lid can be swung only with the distributor boom 18 raised from its boom support block 48 and from its traveling position (FIGS. 1 and 3) overlapping the filling opening 30 into its opened-up working position raised by about 90° (FIGS. 2 and 4). Since the box-form lid overlaps only a part of the filling opening 30 in its traveling position (FIGS. 1 and 3) it has, on a free lower edge 50 of a side wall 52 oriented on a side opposite the horizontal axis 38, a flap 54 overlapping the remaining free part of the filling opening 30 and while in the traveling position. The flap can consist, for example, of a rigid metal plate or of a rubber mat. The flap 54 is hingedly connected to the side wall 52 in such manner that in the working position of the lid 40 (FIGS. 2 and 4), it hangs vertically downward and, in the traveling position, (FIGS. 1 and 3) it overlays the free part of the filling opening. Further, the remaining upper edge of the material dispensing container 24 is bounded by an apron 56 preferably made of rubber, the apron projecting upwardly from the edge 32. In the traveling position, the lid 40 is latched to the material-dispensing container 24 by lid latch 58 which is arranged in the area of the apron 56. For the facilitation of the lid opening process, there engages on the lid 40 one end of a tension spring 60, which spring is fastened at its other end to a chassis-fixed place 62 in the zone of the boom support block 48.

For the arresting of the lid 40 in the open working position, there is provided an automatically engageable locking mechanism which includes a two-armed swinging lever 64 articulated on the outside of the lid and which has a run-on incline 66 and an edge-open locking recess 68 as well as a locking bar 70 rigidly cantilevered from the boom support block 48 for lockingly engaging the swinging lever 64. The swinging lever 64 is actuatable for the releasing of the locking connection by an actuating rod 74 guided for movement on the outside of the lid 40 and articulated on an actuating arm 72 of the swinging lever counter to the force of a tension spring. This unlocking actuation occurs either by hand or under the action of a distributor boom 18 swinging down onto a boom support block 48. The lid 40 is arranged obliquely pointing upward in such manner that it is swung by the downward swinging distributor boom 18 in the direction of the traveling position, without being damaged in the process.

In summary the following is to be stated: The invention relates to a concrete pump vehicle which has a foldable concrete distributing boom 18 arranged on a chassis 10, a material dispensing container 24 arranged near the rearward end of the chassis 10, as well as a concrete pump 28, the suction side of which is connected to the material-dispensing container 24 and the pressure side of which is connected to a delivery line 26 provided on the distributor boom 18. The material dispensing container 24 is provided with a splash-guard arrangement upstanding around the edge of the opening into the container so that when the pump is in operation no concrete splashes pass thereonto. In order both in the traveling state and also in the working state to obtain an optimal splash protection, according to the invention, it is proposed that the splash guard arrangement have a wall construction 36 upstanding around the edge of the opening as well as a lid 40 articulated in the zone of the upper edge of the wall construction 36. The lid 40 has a swinging range correlated to the movement of the distributor boom 18 and can be limitedly swung only with distributor boom 18 lifted off from its support place 48 from a traveling position overlapping the filling opening 30 into a working position opened up by about 90° with respect to this, and can be locked in both positions.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A concrete pump vehicle comprising a chassis constructed as a motor vehicle chassis, a bearing block located in the front zone of the chassis, and a distributor boom arranged turnably about a vertical axis, swingably about a horizontal axis on the bearing block, and comprising several boom arms limitedly swingable with respect to one another about horizontal axes, in the folded state supportable on at least one boom support place in a rearward zone of the chassis, wherein a material-dispensing container is arranged in the vicinity of the rearward end of the chassis having an upward-facing filling opening, wherein a concrete pump is connected on a suction side thereof in the zone of a pump-side boundary wall to the material dispensing container and connected on a pressure side thereof to a delivery line provided on the distributor boom, and wherein a splash protection arrangement is disposed in the zone of the pump-side boundary wall of the material-dispensing container, upstandingly arranged on an edge of the filling opening, wherein the splash protection arrangement has a rigid wall structure arranged in the zone of the pump-side boundary wall of the material-dispensing container, upstanding on the edge, and wherein in the zone of the filling opening there is articulated a lid at a distance from the filling opening, swingable about a horizontal axis extending transversely to a longitudinal axis of the chassis, the swinging range of which correlates with the swinging range of the folded-up distributor boom, which, in the case of the distributor boom being lifted from the boom support place, is limitedly swingable from a traveling position at least partly overlapping the filling opening into a working position folded-up by about 90° with respect to this, and is lockable in the positions mentioned.

2. The concrete pump vehicle according to claim 1, wherein the wall construction is bounded by two side walls that overlie the edge of the side walls of the material-dispensing container oriented perpendicular to the pump-side boundary wall.

3. The concrete pump vehicle according to claim 1, wherein the lid has the form of a box wall-open to the side of the horizontal axis and to the filling opening, the side walls being swingable in the swinging of the lid parallel to the side walls of the wall construction with pairwise mutual overlapping.

4. The concrete pump vehicle according to claim 1, wherein on the lid there engages a spring acting in the working position direction.

5. The concrete pump according to claim 4, wherein the spring is constructed as a tension spring spanned between the lid and the boom support block, exerting on the lid a torque directed in the direction of the working position.

6. The concrete pump vehicle according to claim 1, which includes a locking mechanism arranged between the lid and a chassis-fixed part and which is automatically engageable in the working position of the lid.

7. The concrete pump vehicle according to claim 6, wherein the locking mechanism is automatically releasable under the action of the distributor boom swinging in the direction of the boom support place.

8. The concrete pump vehicle according to claim 6, wherein the lid, after the releasing of the locked connection under the action of the distributor boom swinging in the boom support-place direction, is swingable out of its working position into the traveling position direction.

9. The concrete pump vehicle according to claim 6, wherein the locking mechanism has a fixed stop member arranged on the chassis-fixed part and a stop member arranged on the lid, the stop member being swingable limitedly about a horizontal axis and automatically engageable with the fixed stop member.

10. The concrete pump vehicle according to claim 9, wherein the swingable stop member is constructed as a swinging lever provided with a locking recess edge-open downward in a locking state engaged with the fixed stop member under the action of gravity and/or of a spring.

11. The concrete pump vehicle according to claim 10, wherein the swinging lever is swingable by an actuating member releasable counter to the force of a spring under the action of the distributor boom swingable in the direction of the boom support place into its disengaged position.

12. The concrete pump vehicle according to claim 11, wherein the actuating member includes a spring-loaded thrust rod guided on the lid and articulated on a lever arm of the swinging lever overhanging an edge of the lid at its free end.

13. The concrete pump vehicle according to claim 1, wherein the lid in the working position extends obliquely upward to the rear in respect to the chassis and in the traveling position extends substantially obliquely to the rear downwardly parallel to the plane of the filling opening.

14. The concrete pump vehicle according to claim 1, wherein the box-form lid in traveling position covers over only a part of the filling opening and has on the free under-edge of its face wall lying opposite the horizontal axis a flap overlaying in traveling position the free part of the filling opening.

15. The concrete pump vehicle according to claim 14, the flap is articulated on the side wall under-edge pendulating in such manner that in the working position of the lid it hangs vertically downward and in the traveling position it overlays in parallel the free part of the filling opening.

16. The concrete pump vehicle according to claim 1, wherein the lid has a breakthrough gripped over by rubber plates overlapping one another for the gripping-through of installation parts of the material-dispensing container overhanging the filling opening.

17. The concrete pump vehicle according to claim 1, wherein the lid in its traveling position is releasably connectable with the material dispensing container by means of lateral rapid closures or hood latches.

18. The concrete pump vehicle according to claim 1, wherein the material dispensing container is bounded by an apron made of rubber, edge-open toward the wall structure, and upstandingly arranged on the edge outside the rigid wall structure.

* * * * *